US008297801B2

(12) United States Patent
Coushaine et al.

(10) Patent No.: US 8,297,801 B2
(45) Date of Patent: Oct. 30, 2012

(54) LIGHT EMITTING DIODE DISC OPTIC WITH HEAT SINK HOUSING

(75) Inventors: Charles M. Coushaine, Rindge, NH (US); Michael Tucker, Henniker, NH (US); Thomas Tessnow, Weare, NH (US)

(73) Assignee: Osram Sylvania Inc., Danvers, MA (US)

( * ) Notice: Subject to any disclaimer, the term of this patent is extended or adjusted under 35 U.S.C. 154(b) by 1127 days.

(21) Appl. No.: 10/939,013

(22) Filed: Sep. 10, 2004

(65) Prior Publication Data

US 2006/0013002 A1 Jan. 19, 2006

Related U.S. Application Data

(60) Provisional application No. 60/588,471, filed on Jul. 16, 2004.

(51) Int. Cl.
*F21V 5/00* (2006.01)

(52) U.S. Cl. ..... 362/329; 362/612

(58) Field of Classification Search ..... 362/612, 362/555, 545, 328
See application file for complete search history.

(56) References Cited

U.S. PATENT DOCUMENTS

| | | | | |
|---|---|---|---|---|
| 5,440,456 | A * | 8/1995 | Bertling et al. | 362/520 |
| 6,305,830 | B1 * | 10/2001 | Zwick et al. | 362/520 |
| 6,491,412 | B1 * | 12/2002 | Bowman et al. | 362/241 |
| 6,682,211 | B2 * | 1/2004 | English et al. | 362/545 |
| 6,796,698 | B2 * | 9/2004 | Sommers et al. | 362/555 |
| 6,964,507 | B2 * | 11/2005 | Mohacsi | 362/545 |
| 2002/0085390 | A1 * | 7/2002 | Kiyomoto et al. | 362/555 |
| 2003/0002179 | A1 | 1/2003 | Roberts et al. | |
| 2003/0099115 | A1 * | 5/2003 | Reill | 362/555 |
| 2004/0037087 | A1 | 2/2004 | Desai | |
| 2004/0114393 | A1 * | 6/2004 | Galli | 362/555 |
| 2005/0286145 | A1 * | 12/2005 | Silhengst et al. | 359/742 |

* cited by examiner

*Primary Examiner* — Julie Shallenberger

(74) *Attorney, Agent, or Firm* — Edward S. Podszus

(57) ABSTRACT

A lamp (10) has a cup-shaped body (12) with a planar bottom (14) with an up-standing, peripheral sidewall (16) defining a top (18). The body (12) is thermally conductive and preferably is a metal such as aluminum. A reflective coating (20) is provided on the inside surface of the planar bottom (14) and side wall (16) for reflecting light generated by a single, side emitting LED (22) that is mounted on a thermally conductive, electrically insulating coupling (24) and is positioned substantially in the center of the planar bottom (14). A lens (26) for directing a beam of light emitted from the LED (22) in a desired direction is provided and preferably is a Fresnel optic. The lens (26) can close the opening (18) as shown in FIG. 1 or it can be formed as an integral part of bottom (14) or it can be added to the bottom (14), as shown in FIG. 2. Alternatively, the lens (26) can be solid with the lens elements either external (FIG. 4) or internal (FIG. 5). Electrical connections (28, 30) to the LED extend through the cup-shaped body (14).

8 Claims, 2 Drawing Sheets

LIGHT EMITTING DIODE DISC OPTIC WITH HEAT SINK HOUSING

CROSS-REFERENCES TO RELATED APPLICATIONS

This application is a continuation application filed under 37 CFR 1.53(d)(2) and claims priority from parent application Ser. No. 10/939,013, filed Sep. 10, 2004 and from Provisional Patent Application No. 60/588,471, filed Jul. 16, 2004.

TECHNICAL FIELD

This invention relates to light sources and more particularly to light sources employing light emitting diodes (LED or LEDs) and more particularly to light sources useful in the automotive field such as for headlights, taillights, stoplights, fog lights, turn signals, etc.

BACKGROUND ART

In the past, most automotive light sources have involved the use of incandescent bulbs. While working well and being inexpensive, these bulbs have a relatively short life and, of course, the thin filament employed was always subject to breakage due to vibration.

LEDs are solid state light sources and have achieved recent gains in usage because of their long life; however, it has been found that driving LEDs at the power required for automotive uses generates a considerable amount heat requiring rather elaborate heat sinks for efficient operation.

Accordingly, it would be an advance in the art to simplify heat sinking in LEDs, particularly those for use in automotive applications.

DISCLOSURE OF INVENTION

It is, therefore, an object of the invention to obviate the disadvantages of the prior art.

It is another object of the invention to enhance LED light sources.

These objects are accomplished, in one aspect of the invention, by a lamp comprising a cup-shaped body having a planar bottom with an up-standing, peripheral side wall defining a top, a reflective coating on an inside surface of the planar bottom and side wall, a single, side emitting LED mounted on a thermally conductive coupling positioned substantially in the center of the planar bottom, a lens for directing a beam of light emitted from the LED in a desired direction, and electrical connections to the LED extending through the cup-shaped body.

In a preferred embodiment of the invention the cup-shaped body is thermally conductive thus eliminating the need for extra heat sinking.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
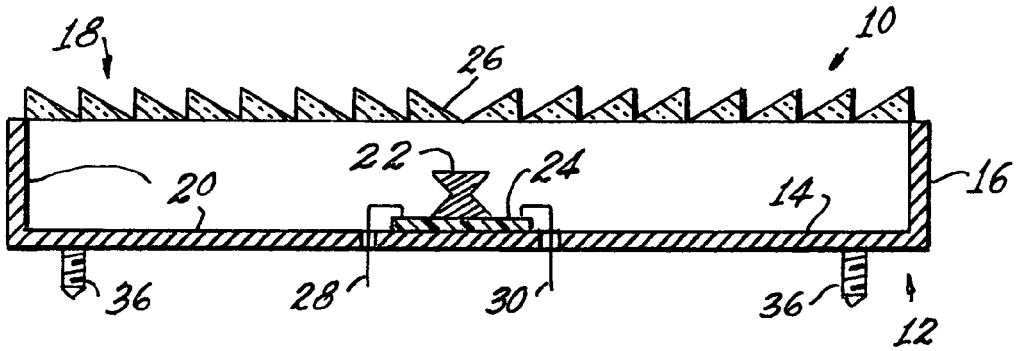
FIG. 1 is a diagrammatic sectional view of an embodiment of the invention.

Referring now to the drawings with greater particularity, there is shown in FIG. 1 a lamp 10 having a cup-shaped body 12 with a planar bottom 14 with an up-standing, peripheral sidewall 16 defining a top 18.

The body 12 is thermally conductive and preferably is a metal such as aluminum. A reflective coating 20 is provided on the inside surface of the planar bottom 14 and side wall 16 for reflecting light generated by a single, side emitting LED 22 that is mounted on a thermally conductive, electrically insulating coupling 24 and is positioned substantially in the center of the planar bottom 14.

Figure 2:
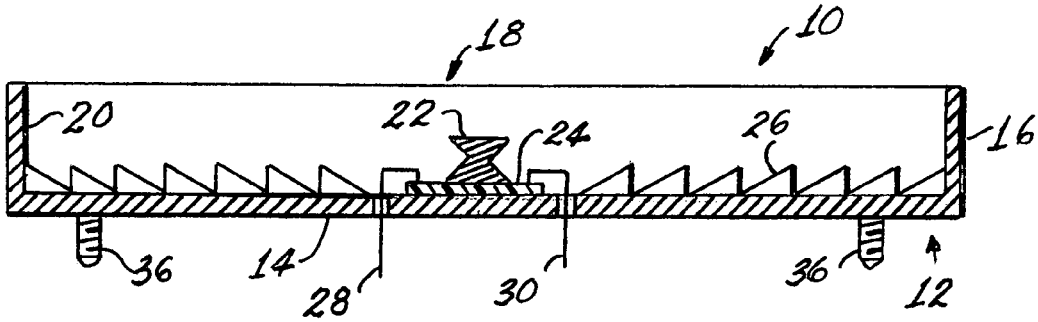
FIG. 2 is a diagrammatic sectional view of an alternate embodiment of the invention.
Figure 4:
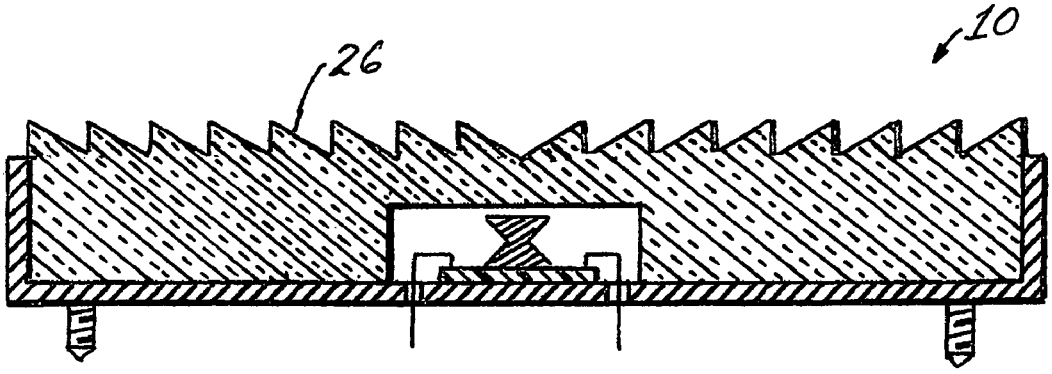
FIG. 4 is a diagrammatic view of yet another embodiment of the invention.
Figure 5:
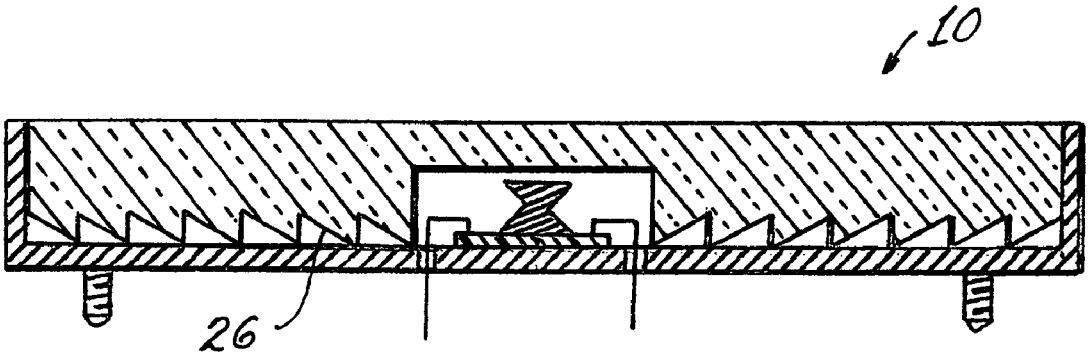
FIG. 5 is a diagrammatic view of still another embodiment of the invention.

A lens 26 for directing a beam of light emitted from the LED 22 in a desired direction is provided and preferably is a Fresnel optic. The lens 26 can close the opening 18 as shown in FIG. 1 or it can be formed as an integral part of bottom 14 or it can be added to the bottom 14, as shown in FIG. 2. Alternatively, the lens 26 can be solid with the lens elements external as shown in FIG. 4 or internal as shown in FIG. 5. Electrical connections 28, 30 to the LED extend through the cup-shaped body 14.

Figure 3:
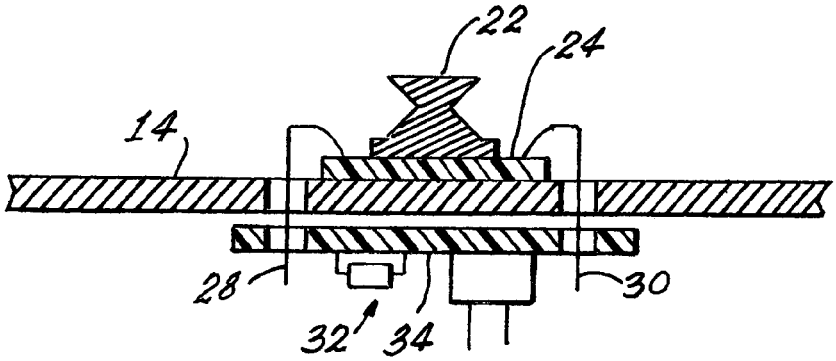
FIG. 3 is a diagrammatic sectional view of yet another embodiment of the invention.

Controlled power can be provided to the LED through circuitry 32, for example, on a printed circuit board 34. The board 34 can be positioned within the cavity formed by the body 14 and the lens 26, when the lens 26 closes opening 18, or it can be positioned externally of the body 12 as shown in FIG. 3. A connector 38 for connection to a power source can also be provided.

Mountings for the lamp 10, such as threaded studs 36, can be provided on the body 12 if desired.

All of the embodiments shown and described provide a flat package with a single LED.

While there have been shown and described what are present considered to be the preferred embodiments of the invention, it will be apparent to those skilled in the art that various changes and modifications can be made herein without departing from the scope of the invention as defined by the appended claims.

What is claimed is:

1. A lamp (10) comprising a vehicle taillight and having a cup-shaped body (12) having a planar bottom (14) with an up-standing, peripheral side wall (16) defining a top (18), said cup-shaped body (12) having a width greater than its height whereby said cup-shaped body (12) is substantially flat and said up-standing peripheral side wall (16) is perpendicular to said planar bottom;

a reflective coating (20) on an inside surface of said planar bottom (14) and said up-standing peripheral side wall (16);

a single side emitting LED (22) mounted on a thermally conductive coupling (24) positioned substantially in the center of said planar bottom (14);

a lens (26) for directing a beam of light emitted from said LED (22) in a desired direction, said lens (26) comprising a plurality of light deflective elements extending along a plane transverse to a lamp axis to defect light emitted by the LED (22), said deflected light having a substantial directional component parallel to said lamp axis; and electrical connections (32) to said LED (22) extending through said cup-shaped body (12) wherein said lens (26) is substantially solid and defines a cavity encompassing said single, side-emitting LED (22) with the lens elements disposed on an exposed outer face of said lens.

2. The lamp (10) of claim 1 wherein said cup-shaped body (12) is thermally conductive to remove heat generated by the operation of said LED (22) from said taillight (10).

3. The lamp (10) of claim 1 wherein said lens (26) contains a Fresnel optic for spreading said beam of light generated when said LED (22) is operating.

4. The lamp (10) of claim 3 wherein said lens (26) closes said top (18).

5. The lens (26) of claim 3 wherein said Fresnel optic is formed on said planar bottom (14).

6. The lamp (10) of claim 1 wherein said lamp (10) includes circuitry (32) providing controlled power to said LED (22).

7. The lamp (10) of claim 6 wherein said circuitry (32) is positioned on the exterior of said cup-shaped body (12).

8. A lamp (10) comprising a vehicle taillight and having a cup-shaped body (12) having a planar bottom 1U~with an up-standing, peripheral side wall (16) defining a to (18), said cup-shaped body (12) having a width greater than its height whereby said cup-shaped body (12) is substantially flat and said up-standing peripheral side wall (16) is perpendicular to said planar bottom;

a reflective coating (20) on an inside surface of said planar bottom (14) and said up-standing peripheral side wall (16);

a single side emitting LED (22) mounted on a thermally conductive coupling (24) positioned substantially in the center of said planar bottom (14);

a lens (26) for directing a beam of light emitted from said LED (22) in a desired direction, said lens (26) comprising a plurality of light deflective elements extending along a plane transverse to a lamp axis to defect light emitted by the LED (22), said deflected light having a substantial directional component parallel to said lamp axis; and electrical connections (32) to said LED (22) extending through said cup-shaped body (12), wherein said lens (26) is substantially solid and defines a cavity encompassing said single, side-emitting LED (26) with the lens elements disposed internal of said lens (26) and in substantial contact with said planar bottom (14).

* * * * *